United States Patent [19]

Sherin

[11] Patent Number: 4,796,936

[45] Date of Patent: Jan. 10, 1989

[54] GAS CYLINDER CARRIER

[76] Inventor: Patrick M. Sherin, P.O. Box 911, Beaver Falls, Pa. 15010

[21] Appl. No.: 144,104

[22] Filed: Jan. 15, 1988

[51] Int. Cl.[4] ..... B65D 63/18

[52] U.S. Cl. ..... 294/31.2; 294/33; 294/148; 294/151; 294/165

[58] Field of Search ..... 294/27.1, 31.2, 33, 294/148–151, 153, 154, 156, 165, 166; 16/114 R; 215/100 A; 220/85 H, 94 R; 248/313

[56] References Cited

U.S. PATENT DOCUMENTS

| | | | |
|---|---|---|---|
| D. 236,410 | 8/1975 | Jenkins et al. | 294/33 X |
| 2,101,526 | 12/1937 | Bryant | 294/33 |
| 2,926,038 | 2/1960 | Hyams | 294/33 |
| 3,177,025 | 4/1965 | Short | 294/33 |
| 3,310,270 | 3/1967 | Ciancio | 294/165 X |
| 3,921,872 | 11/1975 | Buell | 294/31.2 X |
| 4,310,110 | 1/1982 | Dexter | 294/31.2 X |
| 4,402,542 | 9/1983 | Kreutzer | 294/31.2 X |
| 4,458,933 | 7/1984 | Thomas | 294/31.2 |
| 4,723,801 | 2/1988 | Musumeci et al. | 294/33 |

*Primary Examiner*—Johnny D. Cherry
*Attorney, Agent, or Firm*—Walter J. Blenko, Jr.

[57] ABSTRACT

A gas cylinder carrier is provided that consists of a holder and a carrying handle. In use, the holder is merely pressed down on the gas cylinder and the handle engaged to carry the gas cylinder away. The holder is made of a resilient material which expands when initially pressed down on the gas cylinder and when in position, holds the cylinder securely. A strap can also be provided which wraps around the cylinder to keep the holder in a secure, tight fit with the cylinder.

4 Claims, 2 Drawing Sheets

GAS CYLINDER CARRIER

This invention relates to a gas cylinder carrier. More particularly, it relates to a carrier that allows emergency medical personnel and others to quickly and reliably carry away gas cylinders.

Tanks of compressed gas are used in many applications. One common application is to provide a portable oxygen source for medical emergencies. In the emergency medical service, it is necessary to carry compressed gas cylinders containing oxygen into buildings of all kinds and into a variety of outdoor locations such as parking lots, hillsides, or other difficult to reach places. Accordingly, emergency medical service units need a way of quickly and effectively carrying the compressed gas cylinders to the area of the medical emergency.

Compressed gas cylinders are comparatively cumbersome. Because the cylinder carries a compressed gas, special care must be taken that the gas cylinder is not dropped or accidentally bumped. If a charge compressed gas cylinder is dropped so as to shear the valve, the stored energy in the compressed gas will convert the cylinder into a rocket which can easily cause death or serious injuries to persons as well as substantial property damage. When the cylinder contains oxygen, there is also a risk of promoting uncontrolled fire by the release of oxygen. Also, care must be taken in transporting the gas cylinders to the emergency scene because of the tendency for the gas cylinders to roll on the floor of an emergency vehicle.

Various devices have been proposed to carry cylindrical objects such as compressed gas cylinders. The broad concept of a rigid carrier which will encircle and hold a gas cylinder is shown by U.S. Pat. Nos. 3,794,370, 3,817,435, and 4,345,789. The prior art also shows holders in which a strap is tightened around a cylinder in order to secure the carrier to the cylinder. See U.S. Pat. Nos. 4,116,374 and 4,458,933. U.S. Pat. Nos. 4,463,978 and 4,560,193 disclose cylinder carriers of fixed diameters with clamps which are activated by picking up the load of the cylinder with a handle.

Those carriers which require the user to tighten the carrier with a strap are ineffective if the strap is not adequately tightened with the result that the cylinder may slip from the carrier. Those carriers which rely on the weight of the cylinder to activate a clamp are ineffective when the cylinder is in a vertical position or when the weight of the cylinder is not carried by the clamp.

There is a need for a gas cylinder carrier that can be quickly and easily attached to a cylinder for carrying. A carrier is needed which will permit the user to avoid having to adjust a strap around the cylinder or placing the cylinder in an enclosed ring device such as is shown by the prior art. Finally, a carrier is needed which is inexpensive to manufacture and easy to use.

I provide a compressed gas cylinder including a cylinder engaging member, a handle secured thereto and optional strap means. I provide a cylinder engaging member designed so as to snap-on to a compressed gas cylinder, and remain securely positioned thereon so that the gas cylinder can be carried away by using the handle. I may provide a strap means to insure that the cylinder engaging member remains tightly secured to the gas cylinder.

I provide a cylinder engaging member including a segment of a tube whose arc is in excess of 180° and whose inner diameter is at least as small as the outside diameter of the gas cylinder. I prefer that the inner diameter of the cylinder carrier be smaller than the outer diameter of the cylinder to an extent that the material of the carrier will be stressed when it is positioned on the cylinder. I also provide that the material used to make the cylinder engaging member is elastic to an extent which permits the edges of the cylinder engaging member to be opened outwardly such that the distance between the edges is equal to the outside diameter of the cylinder without exceeding the elastic limit of the material.

Other details, objects, and advantages of my invention will become more apparent in the following description of a present preferred embodiment of my invention.

In the accompanying drawings, I have illustrated a present preferred embodiment of my invention in which.

Figure 1:
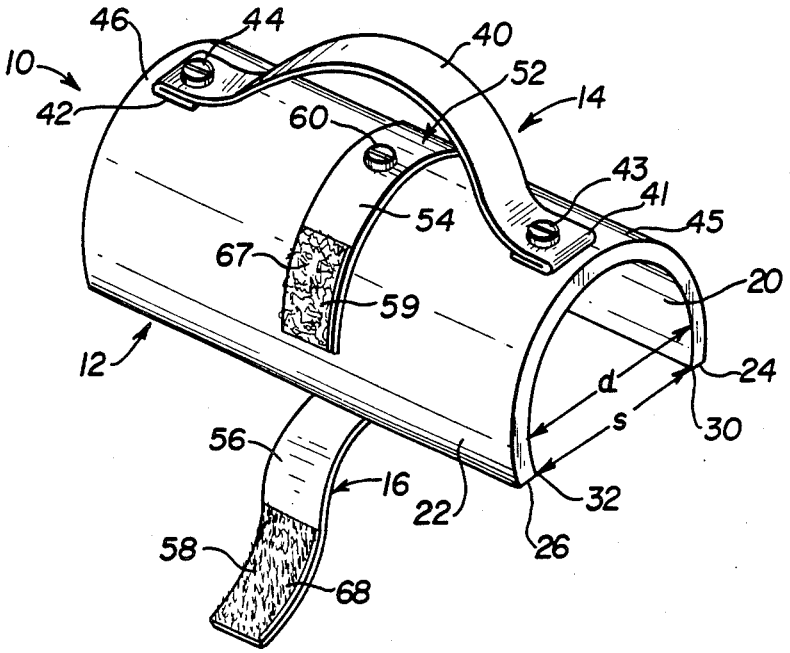
FIG. 1 is a perspective view of the gas cylinder carrier.
Figure 2:
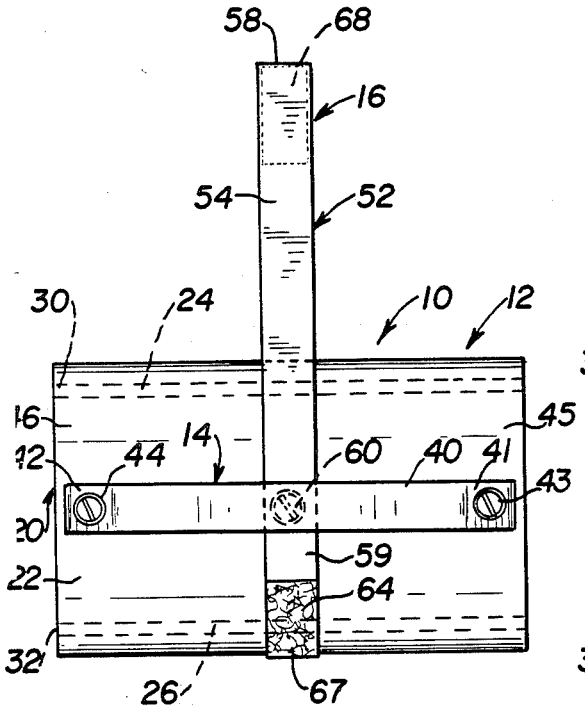
FIG. 2 is a top plan view of the gas cylinder carrier shown in FIG. 1.

The compressed gas cylinder carrier 10 is comprised of a cylinder engaging member 12, handle means 14, and strap means 16. Each of these items will be described in detail below.

The cylinder engaging member 12 is a segment of a tube whose arc is greater than 180°. The tube has an inner face 20, an outer face 22, a first end face 24, and a second end face 26. Two edges, a first inner edge 30 at one end of the arc and a second inner edge 32 at the opposite end of the arc, are formed by the intersection of the inner face 20 and first end face 24 and the inner face 20 and second end face 26, respectively.

Figure 6:
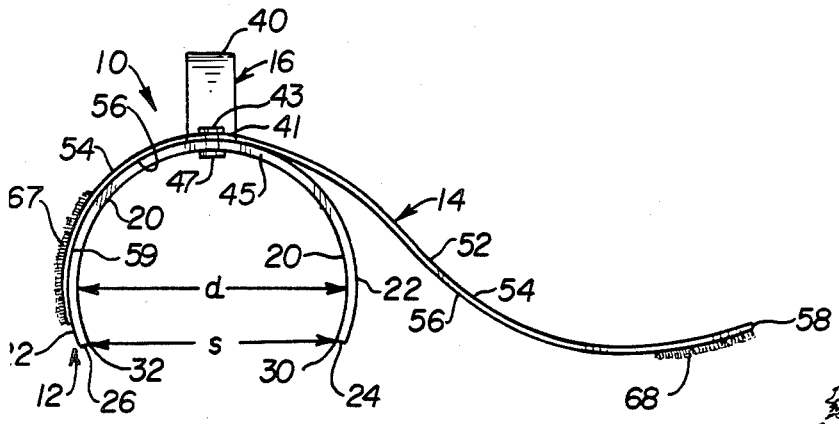
FIG. 6 is a right side elevational view of the gas cylinder carrier shown in FIG. 1.

As the segment of the tube is greater than 180°, the distance "s" between the first inner edge 30 and the second inner edge 32 is less than the diameter "d" of the inner face 20 of the cylinder engaging member 12. This can best be seen in FIGS. 6 and 7, which show right and left side elevational views, respectively, of the carrier 10.

The cylinder engaging member 12 is made of a material which is elastic to an extent that permits the first inner edge 30 and the second inner edge 32 to be opened outwardly such that the distance between the edges is equal to the outside diameter of a cylinder to be carried without exceeding the elastic limit of the material. Suitable materials for the cylinder engaging member 12 may be selected from the group consisting of resinous plastics, light gauge steel and polyvinylchloride. Plastic, however, is preferred as it is an inert material which will not cause sparks and which will not corrode.

Figure 3:
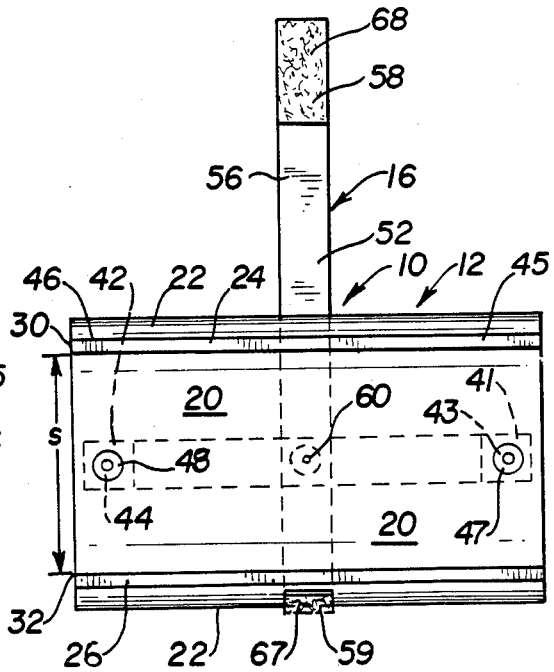
FIG. 3 is a bottom plan view of the gas cylinder carrier shown in FIG. 1.
Figure 4:
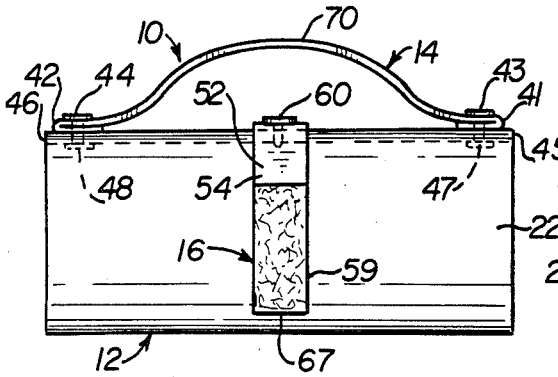
FIG. 4 is a front elevational view of the gas cylinder carrier shown in FIG. 1.
Figure 5:
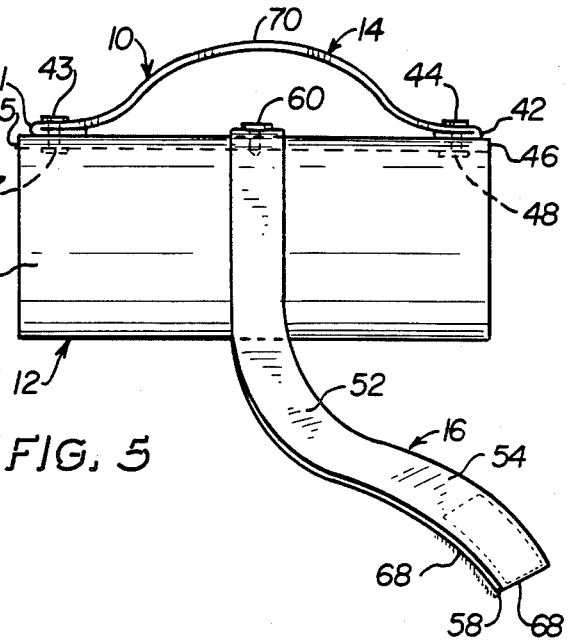
FIG. 5 is a rear elevational view of the gas cylinder carrier shown in FIG. 1.

The handle 14 includes an elongated strip of material 40 having a first connection zone 41 and a second connection zone 42 which is attached by respective rivets 43 and 44. The handle 14 is positioned so that its first connection zone 41 is placed on a first end 45 of the cylinder engaging member 12 and its second connection zone 43 is placed on a second end 46 of the cylinder engaging member 12. The rivets 43 and 44 are driven through the respective ends of the strap 40 and the cylinder carrier member 12 and are capped by fasteners 47 and 48, which can be seen in FIGS. 3, 6, and 7.

The strap means 16 includes an elongated strip of material 52 having a top side 54, a bottom side 56, free end 58 and fixed end 59. The fixed end 59 is secured to the cylinder engaging member 12 by rivet 60, which is driven through the strip 52 and the cylinder engaging member 12. Fastener means in operative association with the strip 52 allow the adjustment of the strip 52. This fastener means preferably consists of Velcro hooks 67 on the top side 54 near the fixed end 59 of the strip 52 and Velcro fasteners 68 on the bottom side 56 near the free end 58 of the strip 52. This design will facilitate wrapping of the strip 52 around the cylinder as will be explained hereinbelow.

The strap means 16 is not an essential part of the carrier. The carrier 10 will still be operable without the strap means 16. The strap means 16 maintains the first inner edge 30 and the second inner edge 32 in the desired spaced relationship "s" with respect to the outside diameter "d" of the cylinder.

Figure 7:
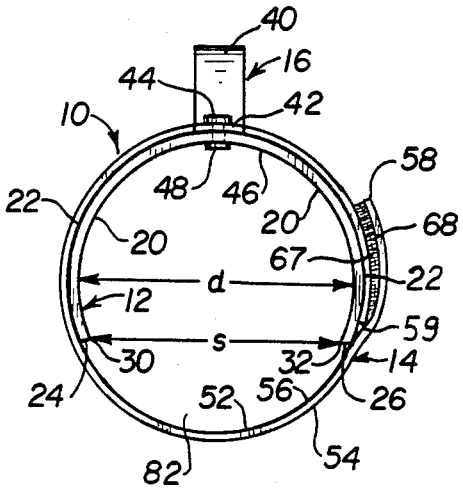
FIG. 7 is a left side elevational view of the gas cylinder carrier shown in FIG. 1.
Figure 8:
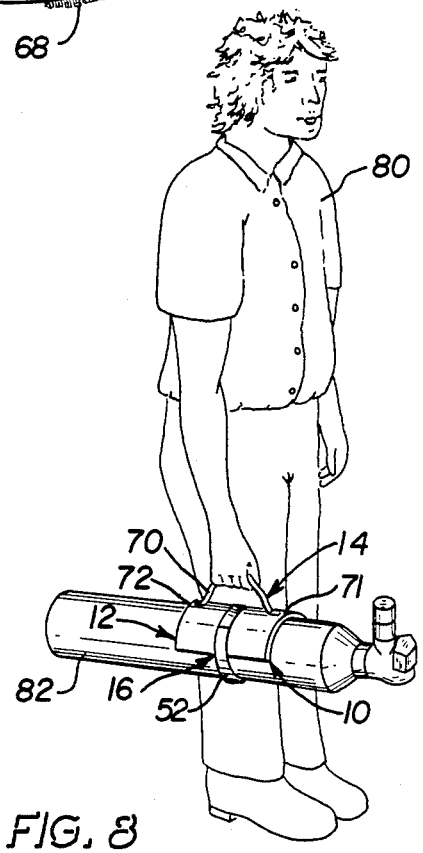
FIG. 8 shows the gas cylinder carrier shown in FIG. 1 in use on a gas cylinder, both being carried by an emergency medical technician.

Referring to FIGS. 7 and 8, the use of the gas cylinder carrier will be discussed. When it is desired to install the cylinder carrier 10 on a gas cylinder 82, the user 80 merely presses the cylinder engaging member 12 down onto the gas cylinder 82 until it is secured thereto. The resiliency of the cylinder engaging member 12 allows the inner edges 30 and 32 to expand at first over the outside diameter "d" surface of the gas cylinder and then "snap-back" and securely engage the outside surface of the gas cylinder. Because the circumferential extent of the cylinder engagement member 12 is greater than 180° and because the inner diameter "d" of the cylinder engagement member 12 is at least as small as the outside diameter of the cylinder 82, it will securely hold the gas cylinder 82 for subsequent carrying away by means of the handle means 16.

If desired, the strap means 14 can be wrapped around the outside surface of the gas cylinder 82 as shown in FIGS. 7 and 8. This is accomplished by taking the free end 58 of the strap 52 having the Velcro fastener 68, wrapping the strap 52 around the portion of the cylinder 82 *not* engaged by the cylinder engaging member 12 and finally contacting the Velcro fastener 68 to the Velcro hooks 67 disposed on the fixed end 59 of the strap 52.

The carrier 10 and the cylinder 82 are then ready to be carried away by the user 80 to the scene of an emergency. Preferably, the carrier 10 will be placed on the cylinder 82 at the station house or medical services building so that the cylinder 82 can be quickly accessed and carried away at the time of the emergency.

The gas cylinder carrier thus provides an effective and quick method of transporting gas cylinders to places at which they are needed. The gas cylinder carrier is economical to manufacture and simple to use.

While we have illustrated and described a present embodiment of the invention, it is to be understood that the invention is not limited thereto and may be otherwise variously practiced within the scope of the following claims.

I claim:

1. A carrier for a compressed gas cylinder and the like comprising a cylinder engaging member including a segment of a tube having an inner face, an outer face, a first end face, a second end face, a first inner edge formed at the intersection of said inner face and said first end face and a second inner edge formed at the intersection of said inner face and said second end face, said segment having an arc the angle of which is in excess of 180° and having an inner diameter which is at least as small as the outside diameter of said cylinder, said first inner edge and said second inner edge being spaced apart from each other a distance less than said outside diameter of said cylinder, said cylinder engaging member being made of material which is elastic to an extent which permits said first and second inner edges to be opened outwardly such that the distance between said edges is equal to said outside diameter of said cylinder without exceeding the elastic limit of said material, strap means associated with said cylinder engaging member for holding said first and second inner edges said distance less than said outside diameter of said cylinder, said strap means including an elongated strip of material having a top side, a bottom side, a free end, and an opposing fixed end which is mounted onto said cylinder engaging member, said strap means having fastener means in operative association therewith, and handle means attached to said cylinder engaging member, whereby said cylinder engaging member is pressed down onto said cylinder and said strap means is wrapped around said cylinder by taking said free end of said strap having said fastener means, wrapping said strap means around the portion of said cylinder not engaged by said cylinder engaging member and contacting said fastener means to said fastener means disposed on said fixed end of said strap so that said cylinder will be held firmly and securely in place by said cylinder engaging member so that said cylinder may be carried away by use of said handle means.

2. The carrier of claim 1, including said strap means having Velcro hooks disposed on said top side near said fixed end and Velcro fasteners disposed on said bottom side near said free end, whereby said strip material can be wrapped around said cylinder engaging member and a portion of said cylinder by said Velcro hooks contacting said Velcro fasteners.

3. The carrier of claim 2, including said fixed end mounted to said cylinder engaging member by strap fastener means.

4. The carrier of claim 1, including said handle means including an elongated strip of material having a first and a second connection zone, each said zone being attached to said cylinder engaging member by handle fastener means which go through said strip and which engage said cylinder engaging member, whereby a portion of said strip may be grasped by a user to carry said cylinder engaging member.

* * * * *